United States Patent [19]

Blatter et al.

[11] 4,379,958

[45] Apr. 12, 1983

[54] GAS-BLAST SWITCH

[75] Inventors: Johann Blatter, Schönenwerd; Walter Schaad, Oberentfelden, both of Switzerland

[73] Assignee: Sprecher & Schuh AG, Aarau, Switzerland

[21] Appl. No.: 183,430

[22] Filed: Sep. 2, 1980

[30] Foreign Application Priority Data

Nov. 22, 1979 [CH] Switzerland ..... 10413/79

[51] Int. Cl.[3] ..... H01N 33/88

[52] U.S. Cl. ..... 200/148 A; 200/148 F

[58] Field of Search ..... 200/148 A, 148 R, 148 F

[56] References Cited

U.S. PATENT DOCUMENTS 3,786,215 1/1974 Mauthe ..... 200/148 A

*Primary Examiner*—Robert S. Macon

*Attorney, Agent, or Firm*—Werner W. Kleeman

[57] ABSTRACT

A movable contact element is secured at the end of a thrust rod and therefore can be brought into and out of engagement with a fixed contact element. The free end of the movable contact element is surrounded by a blast nozzle which is likewise secured to the thrust rod. The inlet of the blast nozzle is operatively connected with a pump chamber containing an extinguishing gas and which can be pressurized during the course of a cut-off stroke of the gas-blast switch. This pump chamber is surrounded at its circumference by a cylinder which is displaceably guided upon a stationarily supported piston. To reduce the mass of the parts which are to be accelerated at the start of the cut-off stroke, the blast nozzle itself is constructed as a second piston situated opposite the first-mentioned piston and displaceable relative to the cylinder between two end positions. Means are provided in order to displace, during a cut-off stroke, the cylinder in the same direction or sense as the movable contact element, but however, through a smaller path than such movable contact element.

6 Claims, 4 Drawing Figures

GAS-BLAST SWITCH

BACKGROUND OF THE INVENTION

The present invention relates to a new and improved construction of a gas-blast switch.

Generally speaking, the gas-blast switch of this development is of the type comprising a movable contact element which is attached at one end of a thrust rod. This movable contact element can be brought into and out of engagement with a stationary contact element. A blast nozzle surrounds the free end of the movable contact element and is attached to the thrust rod. The inlet of the blast nozzle flow communicates with a pump chamber or compartment containing an extinguishing gas and enclosed by a cylinder. This pump chamber can be pressurized during the course of a cut-off stroke of the gas-blast switch, and the cylinder is displaceably guided upon a stationarily supported piston.

Such gas-blast switches are well known in this technology and also have proven themselves in practice by virtue of their simple construction, typically the stationarily supported piston arrangement, since the cylinder also can serve as the movable rated current contact which can be brought into and out of engagement with a suitable stationarily arranged counter contact. Yet, with the heretofore known gas-blast switches, the cylinder is secured by means of a flange or by means of the blast nozzle itself at the thrust rod, i.e. is connected with the movable contact element. This has the result that particularly at the start of the cut-off stroke it is necessary to accelerate appreciable masses. This again requires an extremely efficient switch drive.

SUMMARY OF THE INVENTION

Therefore, with the foregoing in mind, it is a primary object of the present invention to provide a new and improved construction of a gas-blast switch which is not associated with the aforementioned drawbacks and limitations of the prior art constructions.

Another and more specific object of the present invention aims at providing a new and improved construction of a gas-blast switch of the previously mentioned type, wherein the masses which are to be accelerated at the start of a cut-off stroke of the gas-blast switch are appreciably reduced, so that even when working with less efficient drives the contact elements can be brought within the shortest amount of time to their minimum extinguishing spacing or distance from one another, without any loss in the intensity of blowing of the switching arc and without deleting from the cylinder its further function, namely possibly serving as a movable rated current contact.

Now in order to implement these and still further objects of the invention, which will become more readily apparent as the description proceeds, the proposed gas-blast switch of the invention is manifested by the features that the blast nozzle is constructed as the floor or base of a second piston which is situated opposite the first piston. The second piston is displaceable relative to the cylinder, within such cylinder, between two end positions. Further, means are provided in order to move the cylinder, during a cut-off stroke, in the same direction or sense as the movable contact element, but through a lesser distance or path than such movable contact element.

Since the cylinder which moves along with the movable contact element must move through a lesser path than the movable contact element, the work needed for this purpose is likewise less.

The means serving to move the cylinder, during a cut-off stroke, in the same direction or sense as the movable contact element, but through a lesser path, according to the most simple constructional embodiment, can be constituted by a drag connection between the blast nozzle constructed as the piston and the cylinder itself. This drag connection can contain two stops arranged in spaced relationship from one another within the cylinder, these stops determining the end positions of the blast nozzle with respect to the cylinder. The cylinder can be pre-biased by means of a spring in the direction of the cut-off stroke. This spring, which can be more intensely stressed or biased during the course of the cut-on stroke, also serves as a force storage which augments the drive.

On the other hand, the cylinder also can be coupled by means of a drive or transmission, for instance a lever drive, friction wheel drive or gear drive, with the movable contact element and the thrust rod which moves the blast nozzle, this transmission or drive working in an augmenting or assisting fashion in the direction of the cylinder. In this case, the movement of the cylinder in relation to that of the thrust drive is exactly defined throughout each phase of the cut-off stroke.

BRIEF DESCRIPTION OF THE DRAWINGS

The invention will be better understood and objects other than those set forth above will become apparent when consideration is give to the following detailed description thereof. Such description makes reference to the annexed drawings wherein.

DETAILED DESCRIPTION OF THE PREFERRED EMBODIMENTS

Figure 1:
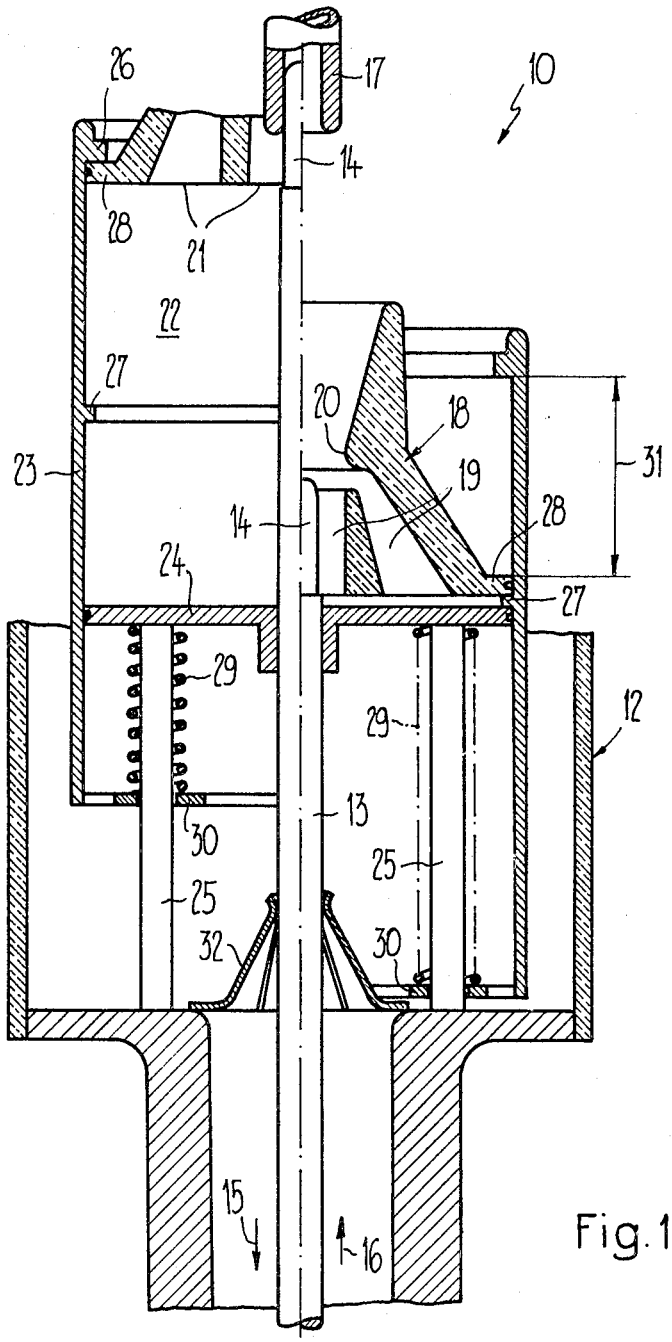
FIG. 1 is a schematic axial sectional view through the essential parts or components of a first exemplary embodiment of gas-blast switch according to the invention.
Figure 2:
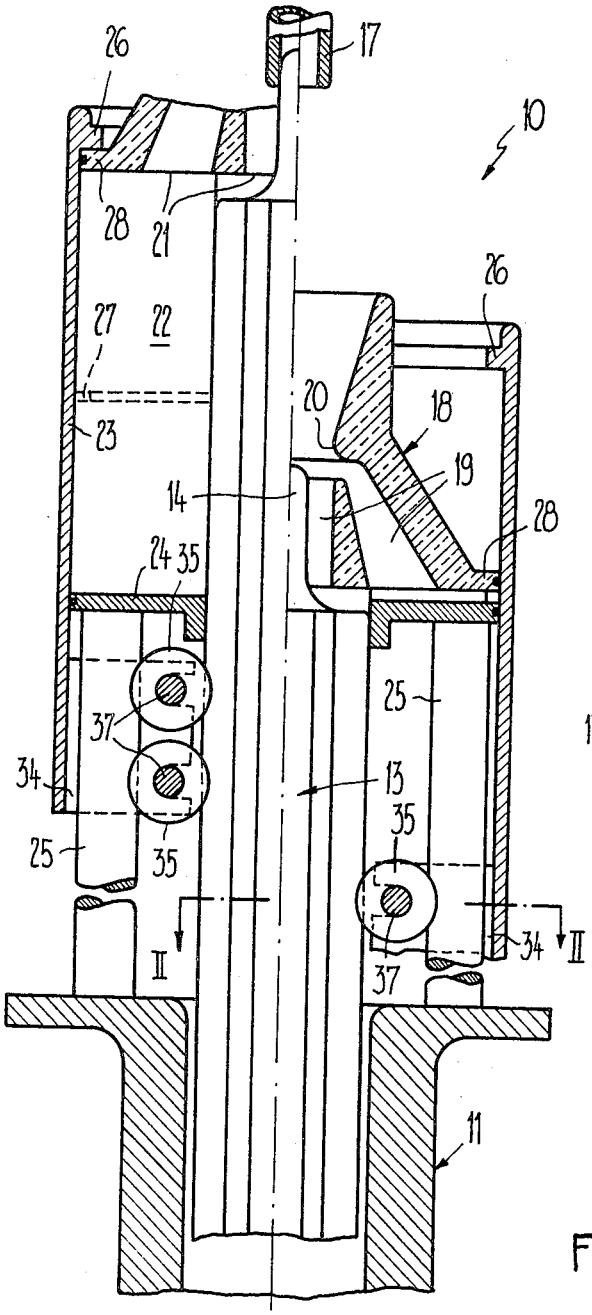
FIG. 2 is a similar illustration as the showing of FIG. 1 of a second embodiment of gas-blast switch.
Figure 3:
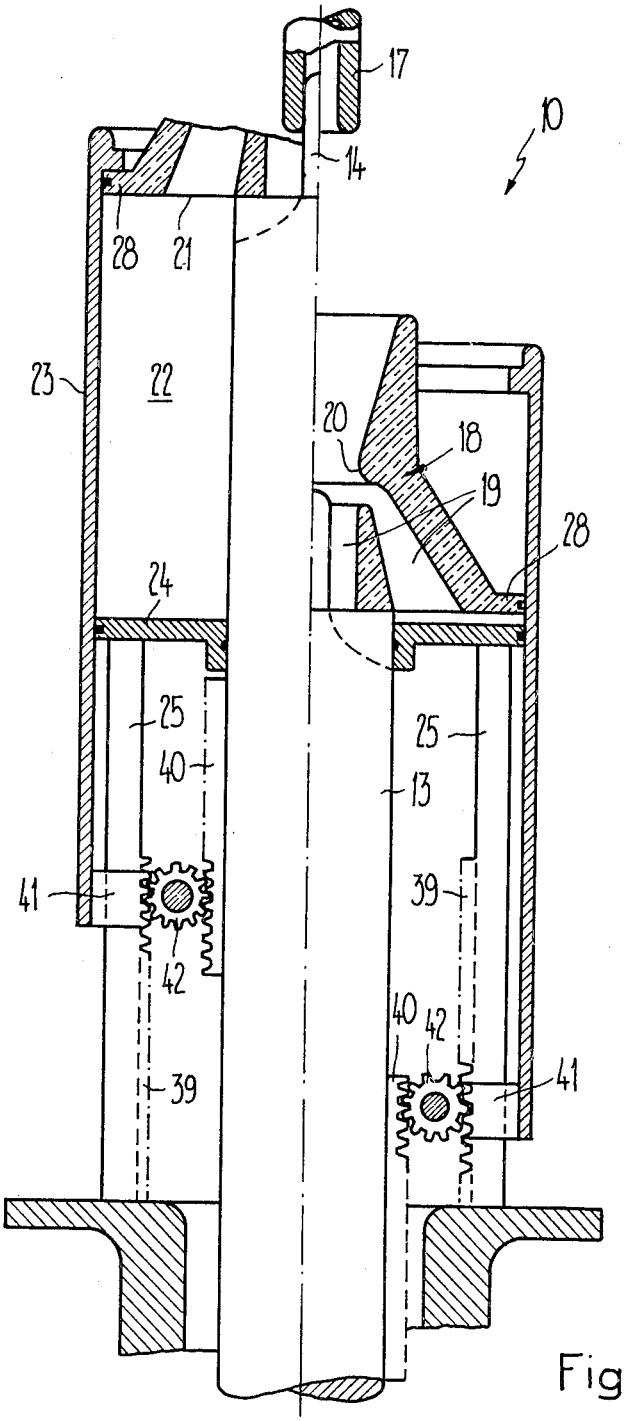
FIG. 3 illustrates a third embodiment of gas-blast switch in axial sectional view.

Describing now the drawing, the illustrated embodiments of gas-blast switches 10 have been shown, in each case, at the left-half of the illustration of FIGS. 1, 2, and 3 in their cut-on position and at the right-hand of such illustrations in their cut-off position. Further, throughout the various embodiments of FIGS. 1 to 3, the same components or parts have been conveniently designated with the same reference characters.

An electrically conductive support or supporting element 11 carries an only partially illustrated tubular-shaped insulation housing 12 in which there are arranged the important components or parts of the gas-blast switch 10 and which contains an extinguishing gas which is under pressure, for instance $SF_6$. A pin-shaped contact element 14, attached at the free end of a thrust rod 13, is brought into and out of engagement with a tubular-shaped, stationarily arranged contact element 17 by means of a not particularly illustrated conventional drive as is well known in this technology. This drive moves the thrust rod 13 either in the direction of the arrow 15 is (cut-off stroke) or in the direction of the arrow 16 (cut-on stroke). At the thrust drive 13, which is connected electrically with the support element 11 by means of the sliding contacts 32, there is attached by any suitable attachment means a blast nozzle 18. This blast nozzle 18 surrounds by means of its nozzle chamber or space 19 the movable contact element 14 and is arranged forwardly of such contact element 14 at its narrowest location or throat 20. As is clearly seen by referring to FIG. 3, the inlets 21 of the blast nozzle 18 are directly in flow communication with the pump chamber or compartment 22. This pump chamber 22 is limited at its circumference by a cylinder 23 which, in turn, is guided to be displaceable upon a pump piston 24. This pump piston 24 is fixedly supported upon the support element 11 by means of a number of columns 25, there being provided at least two such columns 25. The blast nozzle 18 is likewise displaceably mounted in the cylinder 23 and therefore also functions as a piston.

In FIG. 1 there is formed at the inner side or surface of the cylinder 23 at the upper end thereof a first stop or impact member 26 and at the central region a second stop or impact member 27. These stops 26 and 27 are intended to coact with the circumferential flange 28 of the blast nozzle 18 and thus define the degree of relative movement of the blast nozzle 18 within the cylinder 23. These stops 26 and 27 together with the circumferential flange 28 form a drag connection which is effective between the thrust rod 13 and the cylinder 23. At the side of the piston 24 which faces away from the pump chamber or compartment 22 there are supported the one end of compression or pressure springs 29 which surround the columns 25, the other spring ends of which bear and press directly upon a counter support 30 which is rigidly connected with the lower end of the cylinder 23. Thus the cylinder 23 is pre-biased in the direction of the cut-off stroke, and the springs 21 function as a force storage which is coupled by means of the cylinder 23, the stop 26, and the circumferential flange 28 with the thrust rod 13 and at least augment the drive at the start of the cut-off movement and contribute to acceleration of the movable contact element 14.

During the cut-off stroke, the movable contact element 14 and along therewith the blast nozzle 18 move away from the fixed contact element 17. The cylinder 23 likewise distances itself from the fixed contact element 17, however only until its stop 27 comes to bear at the stationary piston 24. Now, the cylinder 23 comes to rest, the circumferential flange 28 releases from the stop 26, and the blast nozzle 18 now functioning as a piston expels the extinguishing gas out of the remaining pump chamber 22 until there has been reached the position shown at the right-hand side of FIG. 1. The cylinder 23 has moved through a path which is less than the path of the switching stroke by the distance indicated by the dimensional arrow 31. During the cut-on stroke, the cylinder 23 initially remains stationary and only then is elevationally raised when the circumferential flange 28 of the blast nozzle 18 impacts against the stop 26, at which time the pressure or compression springs 29 are tensioned.

As mentioned, while in the arrangement of FIG. 1 the cylinder 23 is coupled with the thrust rod 13 by means of a drag connection, there is provided in the arrangements of FIGS. 2 and 3 for such coupling a drive or transmission, and specifically, with the embodiment of FIG. 2, a frictional or force-locking drive and in the embodiment of FIG. 3 a formlocking drive.

Figure 2A:
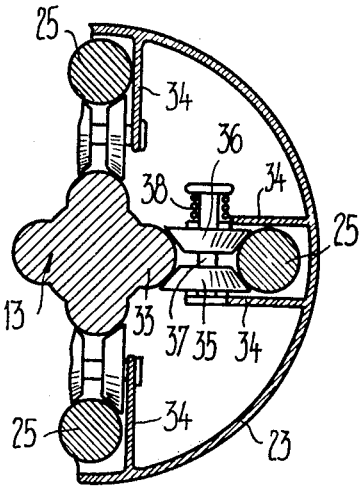
FIG. 2*a* is a schematic sectional view taken along the line II—II of FIG. 2.

As will be apparent from the illustration of FIGS. 2 and 2*a*, with this embodiment there is formed at the circumference of the thrust rod 13 bead portions or protuberances 13 which extend along such thrust drive 13, these protuberances or bead portions having outwardly convex cross-sectional configurations. Further, such beads 33 are arranged in each case opposite to a column member 25 which supports the piston 24. In the same number as there are the number of beads 33 (there have been illustrated four such beads 33, but equally there could only be provided two or three of them) there are attached at the inner surface of the cylinder 23 at its lower region pairs of inwardly extending bearing brackets or bearing overhang means 34, and the bearing brackets 34 of a pair in each case engage with play about one of the column members 25. At each pair of bearing brackets 34 there are rotatably mounted, upon a pin or shaft 37, two pairs of smooth bevel gears 35 and 36. Both of the bevel gears 35 and 36 of a pair are arranged to confront one another at their smaller diameter. The bevel gear 35 is fixedly seated upon the pin or shaft 37 which is rotatably mounted upon the bearing bracket 34, whereas the bevel gear 36 is mounted to be freely rotatable upon this pin 37. The pin 37 which extends past the bevel gear 36 is exposed to the action of a compression or pressure spring 38, so that the bevel gears 35 and 36 are prebiased resiliently against one another. By means of their outer surfaces these bevel gears 35 and 36, on the one hand, roll upon the related stationary column member or column 25, and on the other hand, upon the bead or protuberance 33 formed at the thrust rod 13, and thus, also work as rolling contacts between the thrust rod 13 and the related column 35, in other words between the movable contact element 14 and the support element 11.

It should therefore be apparent that both during the cut-off stroke and also during the cut-on stroke of the gasblast switch the movement of the thrust rod 13 is simultaneously transmitted in the same sense to the cylinder 23 which, however, only moves through one-half of the path of movement of the thrust rod 13. Since the coupling of the cylinder 23 with the thrust rod 13 is a frictional or force locking coupling, in other words not absolutely free of slip, also with this embodiment—as shown in phantom lines—there can be provided a stop or impact member 27, by means of which the cylinder 23 is pressed at the end of the cut-off stroke, by means of the circumferential flange 28 and while overcoming the frictional or force connection between the columns 25 as well as the thrust rod 13, on the one hand, and the bevel gears 35 and 36, on the other hand, into its lowermost position. The same holds true during the cut-on stroke for the stop member 26, by means of which the circumferential flange 28 presses, at the end of the cut-off stroke, the cylinder 23 into the uppermost position.

The most significant differences between the embodiment of FIG. 2 and that of FIG. 3 reside in the fact that in the latter the drive coupling between the thrust rod 13 and the cylinder 23 is a form-locking coupling, in other words, free of slip.

For this purpose, there is attached at the stationary columns or column members 25, a respective rack 39 and at the sides of the thrust rod 13 opposite the columns 25 likewise a rack 40. At the lower region of the cylinder 23 there are attached at the inner surface thereof the bearing overhang elements or supports 41 in which there is freely rotatably mounted a gear 42 which meshes both with the rack 39 and also with the rack 40. The mode of operation of this embodiment extensively corresponds to the embodiment of FIG. 2, with the already mentioned difference that here the coupling between the thrust rod 13 and the cylinder 23 is free of slip. Just as was the case for the embodiment of FIG. 1, it is also possible to provide springs for the embodiments of FIGS. 2 and 3, these springs loading the cylinder 23 in the direction of the cut-off stroke and thus, also, serving as a force storage which augments the switch drive.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A gas-blast switch comprising:

a thrust rod;

a movable contact element secured to one end of said thrust rod;

a stationary contact element;

said movable contact element being capable of being brought into and out of engagement with said stationary contact element;

said movable contact element having a free end;

a blast nozzle secured to said thrust rod and surrounding said free end of said movable contact element;

said blast nozzle having inlet means;

a cylinder containing a pump chamber surrounded by said cylinder;

said pump chamber containing an extinguishing gas;

said inlet means of said blast nozzle being in flow communication with said pump chamber;

said pump chamber during the course of a cut-off stroke of said gas-blast switch being pressurized;

a first stationarily supported piston upon which there is displaceably guided said cylinder;

a second piston situated opposite said first piston;

said blast nozzle being constructed to constitute floor means of said second piston;

said second piston being displaceable relative to said cylinder between two end positions;

means for moving the cylinder during a cut-off stroke of the gas-blast switch in the same direction as the movable contact element but through a smaller displacement path than the path of movement of said movable contact element;

said means for moving the cylinder comprising two stop members arranged within said cylinder;

said stop members cooperating with said second piston for defining the end positions of said cylinder with respect to said second piston and forming with the latter a drag connection between said thrust rod and said cylinder; and at least one spring member for loading said cylinder in the direction of the cut-off stroke of the gas-blast switch.

2. A gas-blast switch comprising:

a thrust rod;

a movable contact element secured to one end of said thrust rod;

a stationary contact element;

said movable contact element being capable of being brought into and out of engagement with said stationary contact element;

said movable contact element having a free end;

a blast nozzle secured to said thrust rod and surrounding said free end of said movable contact element;

said blast nozzle having inlet means;

a cylinder containing a pump chamber surrounded by said cylinder;

said pump chamber containing an extinguishing gas;

said inlet means of said blast nozzle being in flow communication with said pump chamber;

said pump chamber during the course of a cut-off stroke of said gas-blast switch being pressurized;

a first stationarily supported piston upon which there is displaceably guided said cylinder;

a second piston situated opposite said first piston;

said blast nozzle being constructed to constitute floor means of said second piston;

said second piston being displaceable relative to said cylinder between two end positions;

means for moving the cylinder during a cut-off stroke of the gas-blast switch in the same direction as the movable contact element but through a smaller displacement path then the path of movement of said movable contact element;

said means for moving said cylinder comprising step-down drive means; and said step-down drive means coupling said cylinder with said thrust rod.

3. The gas-blast switch as defined in claim 2, further including:

at least one column member for supporting said stationarily supported piston;

said step-down drive means comprising friction gears;

bearing overhang means secured to said cylinder;

the circumference of said friction gears engaging with said thrust rod and said column member; and said friction gears being rotatably mounted at said bearing overhang means.

4. The gas-blast switch as defined in claim 2, further including:

at least one column member for supporting said stationarily supported piston;

said step-down drive means comprising at least one gear;

a respective rack secured to each said thrust rod and said column member;

said gear meshing with both of said racks;

bearing overhang means secured to said cylinder; and said gear being rotatably mounted at said bearing overhang means.

5. The gas-blast switch as defined in claim 3, wherein:

said friction gears defining a respective pair of coaxial smooth bevel gears confronting one another at their smallest diameter; and said bevel gears being resiliently biased towards one another.

6. The gas blast switch as defined in claim 5, wherein:

said thrust rod is provided with bead means extending axially along said thrust rod and having a convex bead-shaped cross-sectional configuration; and the outer surfaces of the bevel gears of each pair engaging with a respective one of the convex bead means.

* * * * *